United States Patent [19]

Brassert et al.

[11] Patent Number: 4,697,520

[45] Date of Patent: Oct. 6, 1987

[54] FOG OIL SMOKE GENERATOR

[75] Inventors: Walter L. Brassert, Belmont; Arnold M. Heitmann, Swampscott, both of Mass.

[73] Assignee: Northern Research & Engineering Corp., Woburn, Mass.

[21] Appl. No.: 895,256

[22] Filed: Aug. 11, 1986

[51] Int. Cl.[4] ..... F42B 13/44

[52] U.S. Cl. ..... 102/334

[58] Field of Search ..... 102/334

[56] References Cited

U.S. PATENT DOCUMENTS

| | | | |
|---|---|---|---|
| 1,301,563 | 4/1919 | Irina | 102/334 X |
| 2,565,352 | 8/1951 | Champney et al. | 102/334 X |
| 4,439,341 | 3/1984 | Swiatosz | 102/334 X |
| 4,459,219 | 7/1984 | Kiley | 102/334 X |

*Primary Examiner*—Peter A. Nelson

*Attorney, Agent, or Firm*—B. J. Murphy

[57] ABSTRACT

The invention is a smoke generator which atomizes fog oil by means of a slinger disc affixed to, and rotating with, a turbine wheel. The atomized fog oil mixes with, and is evaporated by, the hot, turbine exhaust gas. Upon leaving the generator, the evaporated fog oil recondenses into a smoke cloud. The smoke cloud generated is to provide a visual screen on a battlefield for concealing the whereabouts of troops and equipment from observance by an enemy.

5 Claims, 3 Drawing Figures

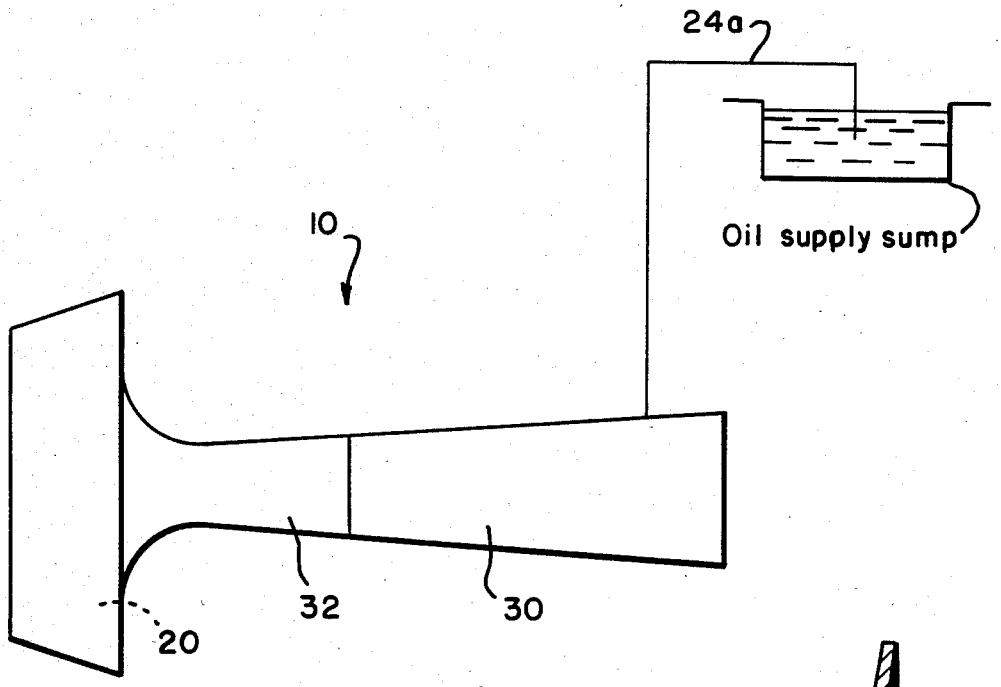
FIG. 1
FIG. 3
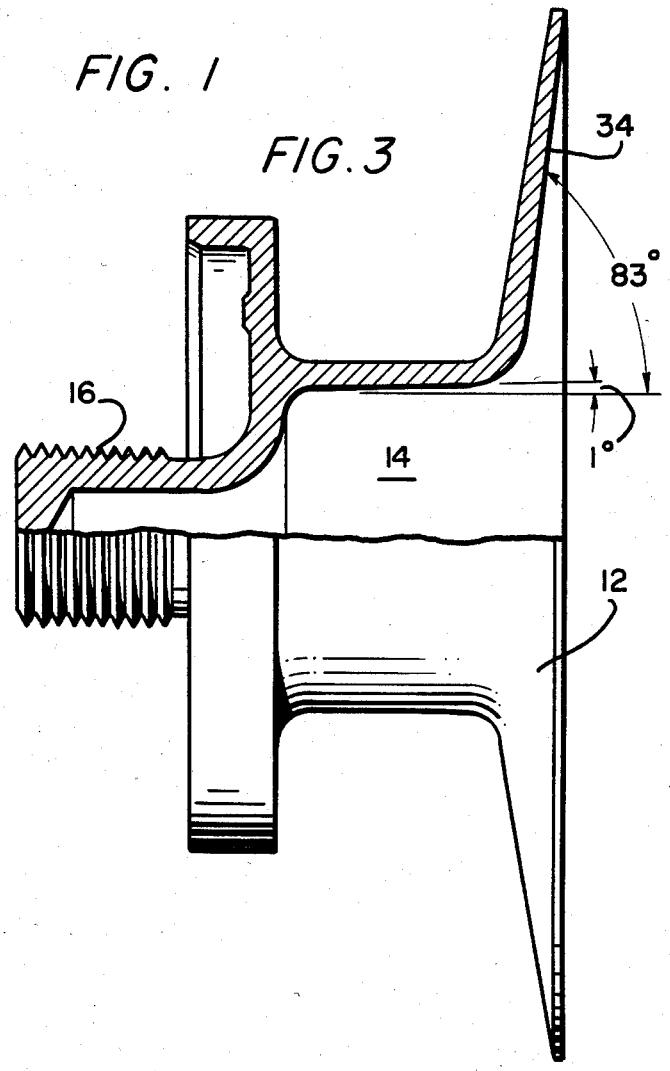

FOG OIL SMOKE GENERATOR

This invention pertains to smoke generators, and especially to such generators designed for producing clouds of smoke to obscure military personnel and/or equipment.

It is an object of this invention to set forth a novel and efficient smoke generator of the aforesaid type. Particularly, it is an object of this invention to set forth a smoke generator, comprising a disc; means for supplying oil to a surface of said disc; means for rotating said disc to cause oil supplied to said surface to remove from said disc in droplets; means for transforming such oil droplets to a vapor; and means for propelling such vapor in a driven direction.

Further objects of this invention, as well as the novel features thereof, will become more apparent by reference to the following description taken in conjunction with the accompanying figures, in which:

FIG. 1 is a simple schematic of the novel smoke generator, according to an embodiment thereof;

FIG. 3 is a half side elevational view, and half cross-sectional view, of the slinger disc of FIG. 2.

Figure 2:
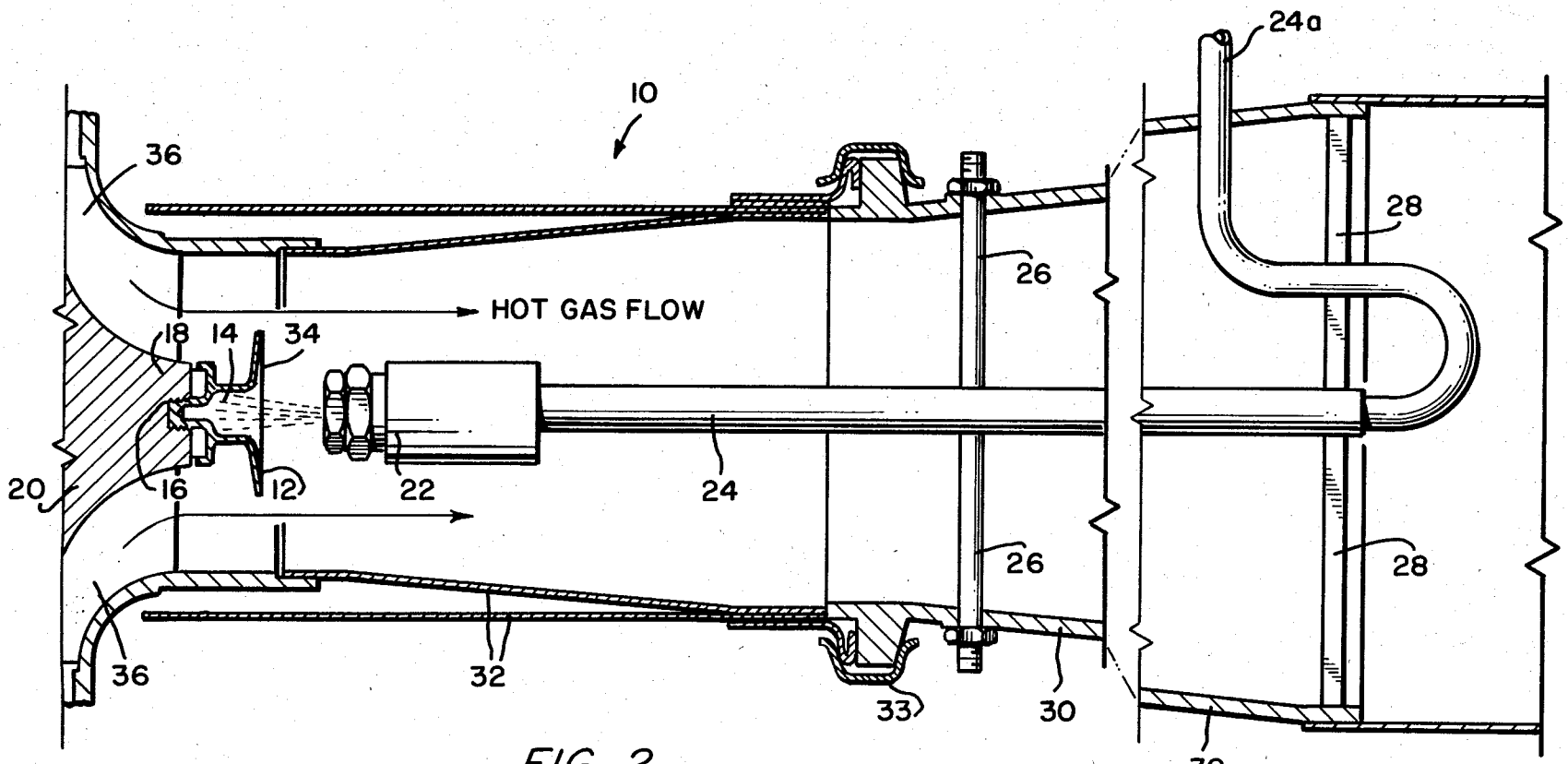
FIG. 2 is a discontinuous, longitudinal, cross-sectional view of the generator of FIG. 1.

As shown in the figures, the novel smoke generator 10 comprises an oil slinger 12. The slinger 12 is a modified disc type with a central, cylindrical, cup-shaped reservoir 14. The slinger 12, or disc, has a threaded portion 16 which fastens the slinger to the hub 18 of a turbine wheel 20. Fog oil is introduced into the slinger 12 by a stationary nozzle 22 mounted in close proximity to the slinger. The nozzle 22 is coupled to an inner end of a conduit 24. Conduit 24 is held in position by struts 26, 28 affixed between the conduit 24 and a smoke generator cone 30. The cone 30 is affixed to the exit portion of the stationary turbine shroud 32, by means of a circular clip 33. The other end of the conduit 24 communicates with an oil supply sump via tubing 24*a*.

The nozzle 22 sprays the fog oil from the sump into the central cylindrical reservoir 14 of the slinger 12 which rotates at the speed of the turbine wheel 20. The oil is accelerated by the slinger 12 and moves outward along the surface of the slinger to its rim 34 where it is flung outward at high velocity. In traveling along the slinger surface, the oil spreads into a thin layer, so that, when it leaves the slinger rim 34 it does so in the form of tiny droplets. The size of the droplets is a function of oil viscosity and of slinger rim speed. In the preferred embodiment of our invention, droplets of approximately 15-micron diameter are formed.

Droplets of small size (10–20 microns) penetrate only a small distance before losing their velocity. In our preferred embodiment, the droplet range is such that none penetrates to the stationary cone 30 or turbine shroud 32. Rather, the droplets form a halo midway between the slinger rim 34 and the turbine shroud 32 where they are immediately picked up and carried along by the hot gas leaving the turbine wheel 20 and impelled by the vanes 36. The droplets mix with the exhaust gas, receive heat from the gas, and evaporate in the region inside the exhaust cone 30. After leaving the cone, the oil recondenses to form an obscuring smoke cloud.

In our embodiment of the invention, the diameter of the rim 34 is large enough to provide the rim speed needed to produce droplets of a small enough size (10–20 microns). The internal cylindrical reservoir 14 is large enough to catch all of the spray from the stationary nozzle 22 but not so large as to unnecessarily reduce the size of the rim portion. The cylindrical reservoir 14 is also conically tapered slightly, or of diverging configuration outwardly toward the rim 34, to prevent excessive oil accumulation and imbalance.

The rim 34 is conically tapered to encourage the oil to spread thinly on its path to the rim; it flares away, and radially outward, from the reservoir 14. The transition from the reservoir 14 to the rim 34 is smooth, with no sharp corners; the transition is made through a radiused juncture.

While we have described our invention in connection with a specific embodiment thereof, it is to be clearly understood that this is done only by way of example and not as a limitation to the scope of our invention as set forth in the objects thereof and in the appended claims.

We claim:

1. A smoke generator, comprising:
a disc;
means for supplying oil to a surface of said disc;
means for rotating said disc to cause oil supplied to said surface to remove from said disc in droplets;
means for transforming such oil droplets into a vapor; and
means for propelling such vapor in a given direction; wherein
said disc has an outer rim, and a central, cylindrical portion;
said cylindrical portion is of diverging configuration, outwardly toward said rim;
said cylindrical portion has a circumferential wall;
said wall and said rim are joined through a smoothly radiused juncture;
said rim flares away, and radially outward, from said cylindrical portion;
said cylindrical portion has an end wall which cooperates with said circumferential wall to define said portion as a cup-shaped reservoir;
said oil supplying means comprises a conduit for conducting oil therethrough and expelling oil therefrom into said reservoir; and
said transforming means comprises a source of heat.

2. A smoke generator, according to claim 1, wherein:
said rim is conically tapered.

3. A smoke generator, according to claim 1, wherein:
said rotating means comprises a wheel having a hub; and
said disc is removably coupled to said hub.

4. A smoke generator, according to claim 3, wherein:
said propelling means comprises vanes coupled to said wheel.

5. A smoke generator, comprising:
a disc;
means for supplying oil to a surface of said disc;
means for rotating said disc to cause oil supplied to said surface to remove from said disc in droplets;
means for transforming such oil droplets into a vapor; and
means for propelling such vapor in a given direction; wherein
said disc has an outer rim, and a central, cylindrical portion;
said cylindrical portion is of diverging configuration, outwardly toward said rim;
said cylindrical portion has a circumferential wall;

said wall and said rim are joined through a smoothly radiused juncture;

said rim flares away, and radially outward, from said cylindrical portion;

said cylindrical portion has an end wall which cooperates with said circumferential wall to define said portion as a cup-shaped reservoir;

said oil supplying means comprises a conduit for conducting oil therethrough and expelling oil therefrom into said reservoir; and said transforming means comprises a source of heat;

a source of oil in communication with one end of said conduit; and a nozzle, coupled to the other end of said conduit, in close proximity to said reservoir for discharging oil into said reservoir.

* * * * *